US007011012B2

(12) United States Patent
Hartsleben et al.

(10) Patent No.: US 7,011,012 B2
(45) Date of Patent: Mar. 14, 2006

(54) FLUID PUMP

(75) Inventors: Alois Hartsleben, Lungau (AT); Josef Walkner, Golling (AT); Andreas Tasche, Abtenau (AT); Guenther Rabanser, Alpbach (AT)

(73) Assignee: Robert Bosch GmbH, Stuttgart (DE)

( * ) Notice: Subject to any disclaimer, the term of this patent is extended or adjusted under 35 U.S.C. 154(b) by 364 days.

(21) Appl. No.: 10/406,256

(22) Filed: Apr. 4, 2003

(65) Prior Publication Data

US 2004/0109775 A1 Jun. 10, 2004

(30) Foreign Application Priority Data

Apr. 5, 2002 (DE) ..... 102 15 038

(51) Int. Cl.
*F01B 31/00* (2006.01)

(52) U.S. Cl. ..... 92/153; 92/73

(58) Field of Classification Search ..... 92/153, 92/72, 73

See application file for complete search history.

(56) References Cited

U.S. PATENT DOCUMENTS

| | | | | |
|---|---|---|---|---|
| 328,521 | A * | 10/1885 | Richards | 92/153 |
| 2,697,403 | A * | 12/1954 | Benedek | 92/72 |
| 3,074,625 | A * | 1/1963 | Paterson et al. | 92/153 |

FOREIGN PATENT DOCUMENTS

| | | |
|---|---|---|
| GB | 837087 | 6/1960 |
| GB | 1159684 | 7/1969 |
| GB | 2057065 A | 3/1981 |

* cited by examiner

*Primary Examiner*—Thomas E. Lazo
*Assistant Examiner*—Michael Leslie
(74) *Attorney, Agent, or Firm*—Ronald E. Greigg

(57) ABSTRACT

A high-pressure fuel pump for internal combustion engines with direct injection includes a housing with a drive chamber in the housing and an eccentric shaft disposed in the drive chamber. A pumping element can be set into a reciprocating motion via the eccentric shaft. To lengthen the service life of the fluid pump the drive chamber in a region located ahead of the pumping element in terms of the direction of rotation of the eccentric shaft or camshaft, communicates with a lubricant relief region.

12 Claims, 2 Drawing Sheets

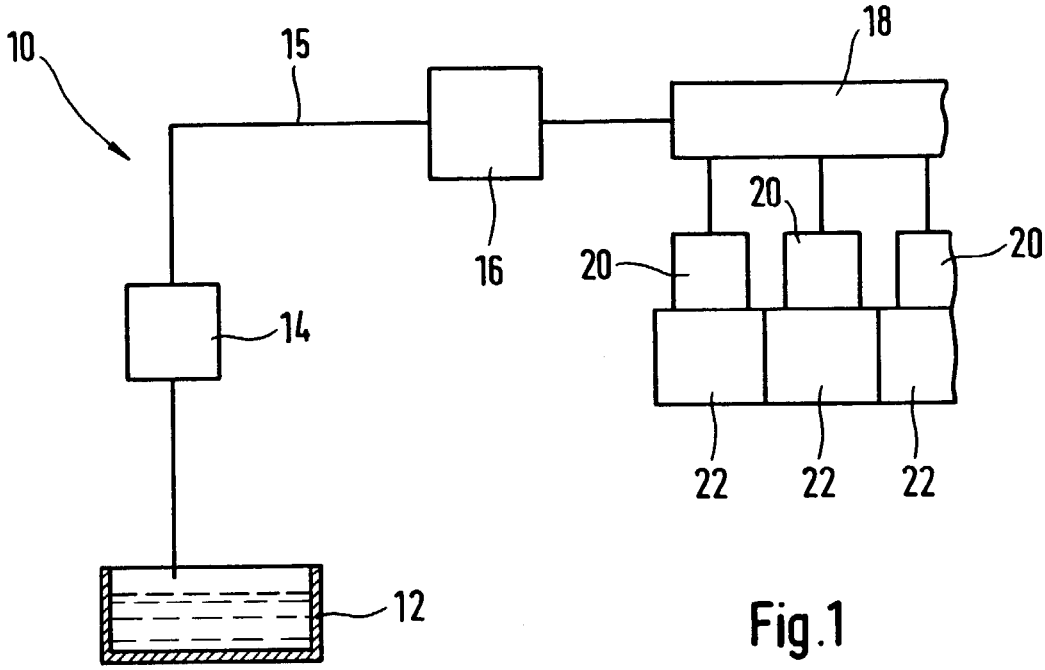
Fig.1
Fig.3
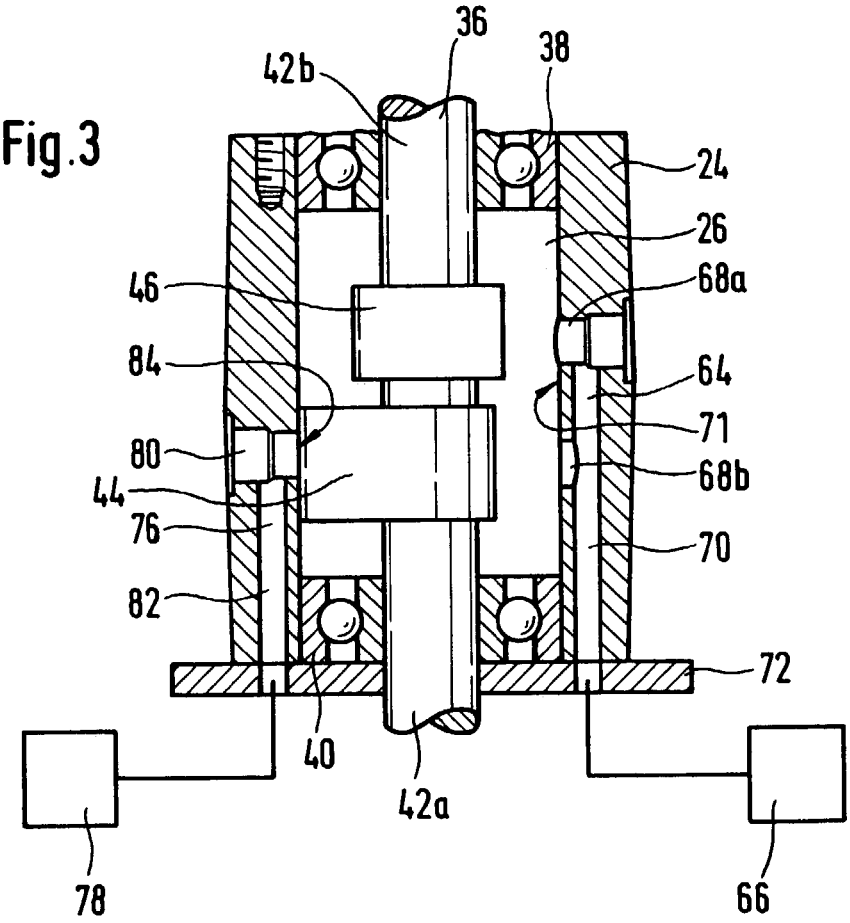

FLUID PUMP

BACKGROUND OF THE INVENTION

1. Field of the Invention

The invention relates to a fluid pump, in particular a high-pressure fuel pump, for internal combustion engines with direct injection, having a housing, a drive chamber in the housing, an eccentric shaft or camshaft disposed in at least some regions in the drive chamber, and at least one pumping element which can be set into a reciprocating motion at least indirectly by the eccentric shaft or camshaft.

2. Description of the Prior Art

A fluid pump of the type described above is known on the market, and is used as a high-pressure fuel pump and in internal combustion engines with fuel direct injection. In such engines, the fuel is first pumped to the high-pressure fuel pump by a prefeed pump. The high-pressure fuel pump then compresses the fuel to a very high pressure and pumps it onward to a fuel collection line, where the fuel is stored at very high pressure. Connected to the fuel collection line are a plurality of injectors, which are assigned one to each combustion chamber and inject the fuel directly into the combustion chambers.

The known high-pressure fuel pump is a multi-cylinder radial piston pump, whose pistons are driven by a camshaft. A camshaft is supported in a housing, and via roller tappets, it sets the pistons into a reciprocating motion. For lubricating the moving parts of the high-pressure fuel pump, this pump is connected to a pressurized lubricant circulation system of the engine. By means of a mounting flange, the lubricant oil can flow out of the high-pressure fuel pump back to the engine.

The present invention has the object of refining a fluid pump of the type defined at the outset in such a way that it has a longer service life.

In such a fluid pump this object is attained in that the drive chamber, in a region that in terms of the direction of rotation of the eccentric shaft or camshaft is ahead of the at least one pumping element, communicates with a lubricant relief region.

SUMMARY AND ADVANTAGES OF THE INVENTION

According to the invention, it has been found that in the conventional fluid pumps, cavitation damage to certain housing edges and to O-rings cannot be precluded. Corresponding traces of cavitation have also been found on the elements that urge the pumping elements against the eccentric shaft or camshaft, and on associated components. These problems no longer arise in the fluid pump of the invention. Thus the service life of the fluid pump of the invention is longer than in conventional fluid pumps.

The reason for the increase in the service life in the fluid pump of the invention is as follows: In the drive chamber, lubricant is normally present, with which the bearings of the driveshaft and the contact face between the eccentric element or cam and the component contacting it are lubricated. Upon a rotation of the eccentric shaft or camshaft, because of the centrifugal effect of an eccentric element or cam of the eccentric shaft or camshaft, some of the lubricant located in the work chamber is applied to the circumferential wall of the drive chamber, or entrained in the form of a "lubricant roller" or wave.

If the protruding or "striking" portion of the eccentric element or cam reaches the region of the components that in the case of a pumping element protrude into the drive chamber and contact the eccentric element or cam, then the available volume for the entrained lubricant becomes less. The effect—without the contrary provisions according to the invention—would therefore be congestion of the oil roller.

Each split stream of the total lubricant oil supplied and intended for guiding a component (such as a roller tappet) contacting the eccentric element or cam emerges partly above and partly below the component. Because of the aforementioned congestion of the oil roller, the oil outflow from the guide of the component into the drive chamber is hindered. Thus more oil emerges upward into the space (such as a spring chamber) located radially outward from the component, where it leads to "overfilling", with an attendant pressure rise.

As a consequence, the lubricant, which of course is largely incompressible, would seek to escape through gaps as well as other connection possibilities and conduits that are typically present from this region into the drive chamber. Such gaps are present for instance between a roller tappet, which can be disposed between the pumping element and the eccentric element or cam, and its guide bore. The excess oil present in the space located radially outward of the component cannot follow the rapid motion of the component (such as the tappet). The result, locally and suddenly at neighboring points, is that the oil vapor pressure drops below what it should be, causing cavitation which until now could lead to the damage described above.

By the provision according to the invention, the lubricant can escape into a lubricant relief region. The pressure surges in a space located radially outward from the component and in the drive chamber are therefore very much less than before.

Advantageous refinements of the invention are disclosed. In a first refinement, the drive chamber, in a region that in the direction of rotation of the eccentric shaft or camshaft is behind the at least one pumping element, communicates with a ventilation region. The drive chamber is as a result ventilated constantly, which makes it easier to divert the excess oil. As a result, the pressure surges occurring in the drive chamber and in the space located radially outward from the component are reduced.

It is also proposed that the eccentric shaft or camshaft has at least two axial eccentric or cam portions, and that each region of the drive chamber where there is an eccentric or cam portion has its own communication with the lubricant relief region and/or with the ventilation region. This has advantages, particularly with multi-cylinder reciprocating piston pumps. Also in such pumps, with the provision or provisions according to the invention, the pressure surges in the aforementioned chambers can be kept slight.

Preferably, the communication of the drive chamber with the lubricant relief region and/or with the ventilation region includes a conduit that ends in a pump flange and has a portion extending axially in the housing. Such a communication is simple to produce. The connections of this axially extending conduit portion to the regions of the drive chamber in which the eccentric or cam portions of the driveshaft are located can be produced by means of simple radial bores.

In a more-concrete embodiment, it is also proposed that the pumping element is acted upon counter to the eccentric shaft or camshaft at least indirectly by a spring, which is received in a prestressing chamber. Until now, the damage from cavitation in such prestressing chambers was especially high. The advantages of the invention are thus especially clear in high-pressure fuel pumps of this kind.

BRIEF DESCRIPTION OF THE DRAWINGS

A particularly preferred exemplary embodiment of the present invention is described in detail below in conjunction with the drawing, in which:

FIG. 1 is a schematic illustration of an internal combustion engine with a high-pressure fuel pump;

FIG. 3 is a section taken along the line III—III of the high-pressure fuel pump of FIG. 2.

DESCRIPTION OF THE PREFERRED EMBODIMENT

Figure 2:
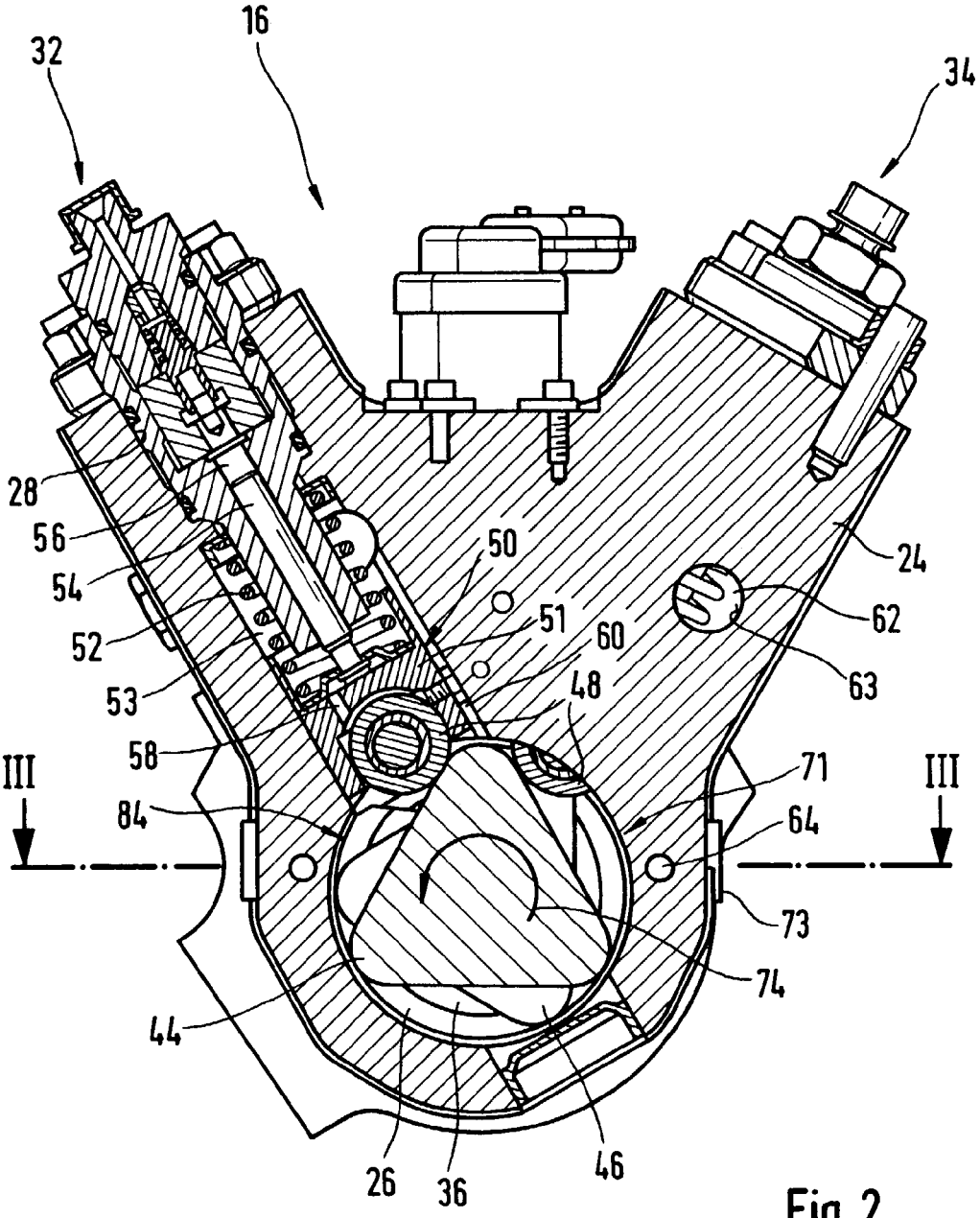
FIG. 2 is a section through the high-pressure fuel pump of FIG. 1.

In FIG. 1, an internal combustion engine, identified overall by reference numeral 10, includes a fuel tank 12, from which a prefeed pump 14 pumps the fuel, via a low-pressure fuel line 15, to a high-pressure fuel pump 16. From there, the fuel passes on to a fuel collection line 18 (or "rail"), in which the fuel can be stored at high pressure. A plurality of injectors 20 are connected to the rail 18 and can inject the fuel directly into corresponding combustion chambers 22.

The high-pressure fuel pump 16 is driven mechanically, in a manner not shown in further detail here, directly by a camshaft, not visible in the drawing, of the engine 10. To that end, the high-pressure fuel pump 16 is flanged to an engine block (not shown) of the engine 10.

The high-pressure fuel pump 16, shown in detail in both FIG. 2 and FIG. 3, includes a housing 24, in which there is a recess of circular cross section, perpendicular to the sectional plane of FIG. 2. This recess is identified by reference numeral 26. Also in the housing 24, extending radially from the recess 26, are a plurality of recesses, one of which is visible in FIG. 2 at reference numeral 28, and which belong to corresponding cylinders 32 and 34, arranged in a V, of the high-pressure fuel pump 16.

A camshaft 36 is received in the recess 26. The recess 26 is therefore also known as a cam or eccentric element tunnel, or simply as a drive chamber. The camshaft is supported relative to the housing 24 of the high-pressure fuel pump 16 via bearings 38 and 40 (see FIG. 3). The camshaft 36 includes shaft portions 42*a* and 42*b* as well as a first cam portion 44 and a second cam portion 46. The two cam portions 44 and 46 are spaced apart axially somewhat from one another. The cam portions 44 and 46 are each triangular, with rounded apexes. Between the rounded apexes of the cam portions 44 and 46 and the circumferential wall of the recess 26, there is a slight gap.

The cylinders 32 and 34 are offset somewhat from one another, in terms of the axial direction of the camshaft 36, each at the level of a respective cam portion 44 or 46 of the camshaft 36. They are constructed identically, so that for the sake of simplicity only the components of the cylinder 32 shown in section in FIG. 2 and visible in detail will now be described:

A roller 48 of a roller tappet 50 runs on the cam portion 44 that belongs to the cylinder 32. The roller 48 is retained rotatably on a body 51 of the roller tappet 50. The roller tappet 50 is guided slidingly in the recess 28. It is urged against the cam portion 44 by a compression spring 52. The compression spring 52 is received in a spring chamber 53 and is braced on a shoulder (not identified by reference numeral) structurally integral with the housing. The roller tappet 50 is also connected to a piston 54, which with its radially outer end defines a feed chamber 56. Via inlet and outlet valves, which are of no further interest here, the feed chamber 56 can be made to communicate on one side with the low-pressure fuel line 15 and on the other with the rail 18.

The spring chamber 53 communicates with the recess 26 via a conduit 58 in the body 51 of the roller tappet 50. A groove 60 in the wall of the recess 28 also connects the spring chamber 53 with the recess 26. Finally, the spring chamber 53 communicates with a spring chamber 62 of the cylinder 34, via a conduit of which, in the view shown in FIG. 2, only a region identified by reference numeral 63 and located perpendicular to the plane of the section is visible.

In the housing 24 of the high-pressure fuel pump 16, there is a conduit 64 (see also FIG. 3), which connects the recess 26, in which the camshaft 36 is disposed, with a lubricant relief region 66. This lubricant relief region 66 can for instance be an oil sump of the engine 10. The conduit 64 includes two portions 68*a* and 68*b*, which are drilled radially relative to the longitudinal axis of the recess 26, and which communicate with a drilled portion 70 of the conduit 64 that extends parallel to the longitudinal axis of the recess 26. The axial portion 70 leads to a pump flange 72 (see FIG. 3), with which the high-pressure fuel pump 16 is secured to the engine block, not shown, of the engine 10.

In the view shown in FIG. 2, the camshaft 36 rotates counterclockwise (arrow 74). In terms of the direction of rotation of the camshaft 36, the radial portions 68*a* and 68*b* of the conduit are located in their circumferential wall of the recess 26 in a region 71 located immediately ahead of the cylinder 34 on the right in FIG. 2. The portion 68*a* is located at the level of the cam portion 46 at the rear in terms of FIG. 2, while conversely the radial portion 68*b* is located at the level of the first cam portion 44 located in the sectional plane in FIG. 2. The portions 68*a* and 68*b* are closed off from the outside by stoppers, not shown in FIG. 3, and of which in FIG. 2 only the one identified by reference numeral 73 is visible. If the stoppers 73 are removed, then a visual inspection of the cam portions 44 and 46 is possible through the conduits 68*a* and 68*b*.

The recess 26 also communicates via a conduit 76 with a ventilation region 78. The ventilation region 78 can for instance be the ambient atmosphere. The conduit 76 is designed similarly to the conduit 74; that is, it includes a radial portion 80 and an axial portion 82 that extends parallel to the longitudinal axis of the recess 26. In contrast to the conduit 64, however, the conduit 76 has only one radial portion 80. This portion is disposed in a region 84 directly behind the cylinder 34 in the circumferential wall of the recess 26, in terms of the direction of rotation of the camshaft 36. In terms of the longitudinal direction of the recess 26, it is located at the level of the first cam portion 44. In an exemplary embodiment not shown, there is a radial conduit portion, which is part of the communication with the ventilation region, in each region of an eccentric or cam portion.

The high-pressure fuel pump 16 is operated as follows:

The roller tappets 50 and as a result also the pistons 15 connected to them are urged against the cam portions 44 and 46, respectively, by the springs 52. Upon a rotation of the camshaft 36, the roller tappets 50 and with them the corresponding pistons 54 are set into a reciprocating motion. Via supply lines, not shown, the recess 26 is supplied with lubricant oil. For instance, the recess 26 can be connected to a pressurized lubricant circulation system of the engine 10. Because the cam portions 44 and 46, at their rounded apexes, have only a slight spacing from the circumferential wall of the recess 26, the lubricant oil located in the recess 26 is entrained, and since the camshaft 36 is rotating very fast, this oil is pressed against the circumferential wall of the recess 26 by centrifugal force. Behind an apex of a cam portion 44 or 46, in terms of the direction of rotation of the camshaft 36, a "lubricant oil roller" thus forms, that is, a region filled with a comparatively large amount of lubricant oil.

If such a lubricant oil roller reaches the region into which the roller tappets 50 of both cylinders 32 and 34 protrude, then only a lesser volume is available for the lubricant oil roller, and thus the lubricant oil escapes to the lubricant relief region 66 through the radial portions 68*a* and 68*b* and the axial portion 70 of the lubricant relief conduit 64. Simultaneously, if one of the rounded apexes of a respective cam portion 44 or 46 moves farther away from the roller tappet 50 of the left-hand cylinder 32, then air from the ventilation region 78 is aspirated into the recess 26 via the radial portion 80 and the axial portion 82 of the ventilation conduit 76.

The conduit 64 thus makes it possible for a lubricant oil roller, arriving in front of an apex of a cam portion 44 or 46, to be carried away to the lubricant relief region 66, while conversely, the conduit 76 assures that in the recess 26, replenishing air can flow into the region of the cam portions 44 and 46, so that excessively large lubricant oil rollers cannot form there at all.

If these conduits 64 and 76 were not present, then the lubricant oil roller accumulating in front of an apex of a cam portion 44 or 46 would then be compressed when it reaches the region of the roller 48 of the roller tappet of the right-hand cylinder 34; the result would thus be a sudden pressure increase in the lubricant located in this region.

The lubricant that reaches the spring chambers 53 through the gaps and conduits that exist between the recesses 28 and the corresponding roller tappets 50 of the two cylinders 32 and 34 cannot flow away unhindered. Because of the major pressure differences, cavitation could occur, particularly in the region of the spring chamber 53. This is prevented to the maximum possible extent by means of the conduits 64 and 76.

The foregoing relates to preferred exemplary embodiments of the invention, it being understood that other variants and embodiments thereof are possible within the spirit and scope of the invention, the latter being defined by the appended claims.

We claim:

1. A fluid pump (16) for internal combustion engines (10) with direct injection, the pump comprising a housing (24), a drive chamber (26) in the housing (24), an eccentric shaft or camshaft (36) disposed in at least some regions in the drive chamber (26), at least one pumping element (54), which can be set into a reciprocating motion at least indirectly by the eccentric shaft or camshaft (36), and a lubricant relief region (66) communicating with the drive chamber (26), in a region (73) that in terms of the direction of rotation of the eccentric shaft or camshaft (36) is ahead of the at least one pumping element (54), wherein the communication of the drive chamber (26) with the lubricant relief region (66) includes a conduit (64, 76) that ends in a pump flange (72) and has a portion (70, 82) extending axially in the housing (24).

2. The fluid pump (16) of claim 1, further comprising a ventilation region communicating with the drive chamber (26), in a region (84) that in the direction of rotation of the eccentric shaft or camshaft (36) is behind the at least one pumping element (54).

3. The fluid pump (16) of claim 1, wherein the eccentric shaft or camshaft (36) comprises at least two axial eccentric or cam portions (44, 46), and wherein each region (71) of the drive chamber (26) where there is an eccentric or cam portion (44, 46) has its own communication (68*a*, 68*b*) with the lubricant relief region (66).

4. The fluid pump (16) of claim 2, wherein the eccentric shaft or camshaft (36) comprises at least two axial eccentric or cam portions (44, 46), and wherein each region (71) of the drive chamber (26) where there is an eccentric or cam portion (44, 46) has its own communication (68*a*, 68*b*) with the ventilation region.

5. The fluid pump (16) of claim 1, wherein the pumping element (54) is acted upon counter to the eccentric shaft or camshaft (36) at least indirectly by a spring (52), which is received in a prestressing chamber (53).

6. The fluid pump (16) of claim 2, wherein the pumping element (54) is acted upon counter to the eccentric shaft or camshaft (36) at least indirectly by a spring (52), which is received in a prestressing chamber (53).

7. The fluid pump (16) of claim 3, wherein the pumping element (54) is acted upon counter to the eccentric shaft or camshaft (36) at least indirectly by a spring (52), which is received in a prestressing chamber (53).

8. The fluid pump (16) of claim 4, wherein the pumping element (54) is acted upon counter to the eccentric shaft or camshaft (36) at least indirectly by a spring (52), which is received in a prestressing chamber (53).

9. The fluid pump (16) of claim 1, wherein the pumping element (54) is acted upon counter to the eccentric shaft or camshaft (36) at least indirectly by a spring (52), which is received in a prestressing chamber (53).

10. The fluid pump (16) of claim 3, wherein the pumping element (54) is acted upon counter to the eccentric shaft or camshaft (36) at least indirectly by a spring (52), which is received in a prestressing chamber (53).

11. The fluid pump (16) of claim 2, wherein the pumping element (54) is acted upon counter to the eccentric shaft or camshaft (36) at least indirectly by a spring (52), which is received in a prestressing chamber (53).

12. The fluid pump (16) of claim 4, wherein the pumping element (54) is acted upon counter to the eccentric shaft or camshaft (36) at least indirectly by a spring (52), which is received in a prestressing chamber (53).

* * * * *